US007299785B1

(12) United States Patent
Lee

(10) Patent No.: US 7,299,785 B1
(45) Date of Patent: Nov. 27, 2007

(54) EMBEDDED IGNITER SYSTEM FOR INTERNAL COMBUSTION ENGINES

(75) Inventor: Larry C. Lee, San Diego, CA (US)

(73) Assignees: Bruce D. Browne, National City, CA (US); Frank Barone, National City, CA (US)

( * ) Notice: Subject to any disclaimer, the term of this patent is extended or adjusted under 35 U.S.C. 154(b) by 0 days.

(21) Appl. No.: 11/512,927

(22) Filed: Aug. 30, 2006

(51) Int. Cl.
*F02P 15/08* (2006.01)
*F02P 15/02* (2006.01)
*H01T 13/46* (2006.01)

(52) U.S. Cl. ..... 123/310; 123/169 EL; 313/128

(58) Field of Classification Search ..... 123/310, 123/311, 169 R, 169 EL, 169 MG, 163, 143 R; 313/123, 128
See application file for complete search history.

(56) References Cited

U.S. PATENT DOCUMENTS 2,904,610 A * 9/1959 Morrison ..... 123/169 R
4,004,562 A * 1/1977 Rado et al. ..... 123/169 MG
4,436,068 A * 3/1984 Nakamura et al. ..... 123/310
4,470,392 A * 9/1984 Yoshinaga et al. ..... 123/310
4,535,735 A * 8/1985 Yoshinaga et al. ..... 123/310
5,046,466 A * 9/1991 Lipski ..... 123/310
6,161,520 A * 12/2000 Clarke ..... 123/310
6,807,933 B2 * 10/2004 Lipski ..... 123/169 EL
2004/0195949 A1 * 10/2004 Hiramatsu ..... 313/135

* cited by examiner

*Primary Examiner*—Stephen K. Cronin
*Assistant Examiner*—Arnold Castro
(74) *Attorney, Agent, or Firm*—Richard D. Clarke

(57) ABSTRACT

An embedded igniter for internal combustion engines consisting of a multiple ignition system with separate control for individual pairs of igniters that has been designed to replaces the spark plugs of internal combustion engines. This device allows for a more complete burn of the fuel/air mixture within the combustion chamber. The embedded igniter system will consist of one or more igniter units consisting of a pair of rectangular tantalum bars with iridium electrode pins at the ends. The paired igniter pins are encased in alumina ceramic, a high dielectric/high temperature housing positioned around the combustion chamber holding and insulating the electrodes relative to their position in reference to the combustion chamber. One or more igniter units may be incorporated around each cylinder opening of a head gasket made from a composite of polyamide, carbon fiber and copper or equivalent material or may be incorporated into an internal combustion engine that does not require a head gasket.

20 Claims, 6 Drawing Sheets

EMBEDDED IGNITER SYSTEM FOR INTERNAL COMBUSTION ENGINES

FIELD OF THE INVENTION

This invention relates to the field of the spark ignition systems on internal combustion engines with one or more cylinders where a spark is required to ignite a combustible fuel/air mixture. In general, this patent replaces the spark plugs of internal combustion engines with one or more pairs of individually controlled embedded igniters.

BACKGROUND OF THE INVENTION

In a wide variety of internal combustion engines the fuel ignition characteristics have become important from the viewpoints of fuel consumption and exhaust gas emissions. With the rising costs of oil and the air pollution problems, it has become imperative that new methods of saving fuel and having a cleaner more complete burn within the combustion chamber be devised. In order to attain lower, more efficient fuel consumption it is necessary to increase the combustion efficiency of the internal combustion engines. The spark plugs used in internal combustion engines have not changed significantly since they were first installed in the automobiles of the past. It is known that the ignition and complete burning of the fuel/air mixture in the combustion chambers of the internal combustion engine can be improved by using a dual spark plug ignition system. Multiple plugs have proven higher in performance and fuel economy over single spark plugs, but because of limited area in the surface of the cylinder head combustion chamber for valves and plugs, just two plugs can be used to aid in flame propagation and to diminish the pre-detonation in high compression low octane engines of a few high-end automobiles.

The burning of fuel in the conventional internal combustion engines has been improved in recent years due to regulations but is no where close to a complete burn of the fuel/air mixture, which is a major contributor to our air pollution problem. Even the gasoline powered lawn mower has been indicated as contributing significantly to the pollution problem.

The igniters for internal combustion engines of this patent has been designed by the inventor to replace the conventional spark plugs in the piston-driven internal combustion engines having one or more cylinders. More specifically this invention describes the replacement of the spark plugs with one or more unique pairs of igniters that are embedded around the periphery of the cylinder within the structure of the head gasket that is seated between the head and block of the internal combustion engine. The igniters can also be positioned around the periphery of the cylinder where the engine head and engine block are joined on internal combustion engines that do not use head gaskets. This invention provides that the igniters will last the life of the engine and not have to be replaced like conventional spark plugs along with giving increased fuel economy and minimizing unburned fuel emissions.

The recent discovery of new and exotic materials has led to the developments in reducing the size while increasing the capabilities of many products. A new material used in this product as a ceramic insulator is made of alumina. Alumina or aluminum oxide ($Al_2O_3$) is the most versatile engineered ceramic because of its high temperature service limit along with its chemical, electrical and mechanical properties. It is also relatively low in cost, is easily formed and finished, using a number of fabrication methods including injection molding for low cost, high volume production runs. It is often compounded with silica or trace elements to enhance its properties of fabrication and commonly will range from 92% to 99.8% $Al_2O_3$.

Iridium is a relatively new and exotic material that will be used for the contact points because it will transmit a spark and not glow at the combustion temperature to ignite the next incoming charge.

U.S. Pat. No. 4,436,068 of Norihiko Nakamura et al. describes an ignition system of an internal combustion engine comprising a metallic plate inserted between the cylinder block and the cylinder head. The metallic plate has an opening, upon the inner peripheral wall of which is mounted a plurality of T-shaped electrodes. Each of the T-shaped electrodes comprises an electrode piece and a conductive bar member connected to the electrode piece. The conductive bar member is surrounded by a tubular insulating member. The tubular insulating member is inserted into bores formed in the metallic plate for forming a condenser between the conductive bar member and the metallic plate. The electrode pieces are arranged in series for forming spark gaps between adjacent electrode pieces, and a high voltage is applied across the electrode pieces.

The Nakamura patent describes an ignition system using a metallic plate between the head and the block of the engine requiring two gaskets instead of the conventional single gasket. The electrodes are arranged in series applying an extremely low voltage across the electrode pieces. The innate spark occurring at each gap around the perimeter of the combustion chamber simultaneously will ignite the combustion with the power and explosion of a diesel engine rather than a controlled burn desirable in a conventional internal combustion engine. The problem may be exacerbated by timing advance, which could cause the combustion to explode early enough to deter the piston from reaching top dead center. The thickness of the metallic plate will have an undesirable effect on the area of the combustion chamber.

U.S. Pat. No. 4,470,392 of Toru Yoshinaga et al. describes a multi-gap spark ignition device to be installed in a spark ignition engine. The device comprises a metallic base member provided with a hole, which forms one portion of the combustion chamber of the engine. Within the wall defining the hole, a electrode, a plurality of intermediate electrodes and an earth electrode are embedded at regular intervals so that each end of the electrodes project into the hole to form a plurality of spark gaps between the adjacent ends of the electrodes. Each of the intermediate electrodes is composed of an electrode member and an insulating member for covering one end of the electrode member, and is closely inserted into a groove formed in one end surface of the base member along the hole thereof at regular intervals. By making the stray electrostatic capacity between the base member and the opposed electrode member of each intermediate electrode larger than the electrostatic capacity between the adjacent electrode members, the required voltage can be maintained small, irrespective of the number of the intermediate electrodes.

The Yoshinaga patent describes another attempt with the electrodes arranged in series applying an extremely low voltage across the electrode pieces. The innate spark occurring at each gap around the perimeter of the combustion chamber simultaneously will still ignite the combustion with the power of an explosion. The spark electrodes exposed to the chamber will not be able to endure the heat range associated with the chamber requirements. The electrodes may still be glowing and could ignite the next incoming charge. Instead of removing the spark plugs in the conventional manner in an internal combustion engine, this system would require the major job of removing the heads to replace the device.

U.S. Pat. No. 4,535,735 of Toru Yoshinaga describes a multi-gap spark ignition system. The system comprises a plurality of spark gaps, which are formed in series. The length of the spark gaps increases from the high voltage power source side towards the earth side. According to the present invention, necessary voltage to be applied to the spark ignition system can be decreased.

This patent describes still another attempt with the electrodes arranged in series applying an extremely low voltage across the electrode pieces. The multiple spark ignition system has an intrinsically short life span because all the gaps are firing all the time and the life span will emulate at best the conventional spark plug.

U.S. Pat. No. 5,046,466 of Frank F. Lipski describes a spark-ignition engine that incorporates a relatively unlimited number of spark sources within each combustion chamber, without conventional spark plugs being required. The engine includes a planar circuit module clampingly located between a cylinder assembly and a head assembly of the engine. The module includes an electrically insulative substrate; a pair of electrode members; a foil circuit on the substrate for connecting the electrode members to a pulser that generates a high voltage intermittent electric signal for producing spark ignition of the fuel within a combustion chamber of the engine; first and second seals for connecting the substrate to the cylinder assembly and the head assembly. Also disclosed is a kit for replacing spark plugs in an internal combustion engine, the kit including the circuit module and in one version, injector assemblies for use in place of the spark plugs.

The Lipski patent describes another attempt with the electrodes arranged in series. The multiple spark ignition patent and others show an exposed electrode in the combustion area. These electrodes are not insolated from sparking to the piston. The initial timing on most engines is about 6 degrees before top dead center. In the 6-degree position, the piston is close enough to the electrode to cause a spark to jump to the piston or head and result in damaging surrounding components.

U.S. Pat. No. 6,161,520 of William A. Clarke describes a gasket of non-conductive material formed of layers of ceramic between which is embedded a wire circuit for connecting spark electrodes, connectors and ground connectors of a spark ignition system. The wire circuit includes small diameter wires surrounding gasket openings for bonding and sealing the edges of combustion chambers defined by cylinders in an internal combustion engine. The small diameter wires are insulated by the high dielectric layers of the gasket as well as by high dielectric wrappings and a sheath of high dielectric material bonded to and within the layers forming the gasket.

The Clarke patent describes another attempt with the electrodes arranged in series that will not allow the capability of firing the electrodes individually.

U.S. Pat. No. 6,935,302 of Toshimi Kashiwagura et al. describes an in-cylinder injection type internal combustion engine is provided, which initially fires a first spark plug and thereafter fires a second spark plug when a required load is low and which first fires the second spark plug and thereafter fires the first spark plug when the required load is high.

This patent describes an in-cylinder injection type internal combustion engine with two separate spark plugs located in the cylinder head illustrating the capability of multiple spark plugs and desire to produce an internal combustion engine with a multiple spark ignition system.

None of the foregoing prior art teaches or suggests the particular unique features of the embedded igniter system and thus clarifies the need for further improvements in the field of spark ignition on internal combustion engines with one or more cylinders where a spark is required to ignite a combustible fuel/air mixture.

SUMMARY OF THE INVENTION

The primary object of the invention is to create a more efficient internal combustion engine.

Another object of the invention is to create an individually controlled embedded igniter system that will reduce emissions by providing an accelerated complete burn, by multiple flame fronts within the combustion chamber.

Another object of the invention is to create an embedded igniter system that will increase torque by igniting the firing charge closer to the piston when it is at top dead center.

Another object of the embedded igniter system is to reduce ping and knock with low octane fuels by having a controlled ignition producing multiple flame fronts around the periphery of the combustion chamber.

Another object of the embedded igniter system is to increase fuel mileage by using a leaner air/fuel mixture.

Another object of the invention is to produce a embedded igniter system that will last the life of the engine by employing a switching power supply and changing the duty cycle assignments of electrode pairs.

Another object of the invention is eliminating the central location of the spark plug in the head, frees up the combustion chamber shape to develop advanced swirl and squish technology.

Another object of the invention is being able to add the embedded igniter system to an existing internal combustion engine and plugging the spark plug hole.

Another object of the invention is to eliminate the homogeneity, emphasis and narrow focus upon varying spark plug heat range requirements of conventional internal combustion engines.

Still another object of the embedded igniter system is to eliminate the auto advance on conventional internal combustion engines by sequentially adding another pair of firing igniters as needed.

In addition, another object of the embedded igniter system is to lower octane fuel requirements for internal combustion engines.

A final object of the embedded igniter system is to reduce specific fuel consumption for all internal combustion engines while minimizing undesirable emissions.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying summary, drawings and descriptive matter in which there are illustrated preferred embodiments of the invention. There has thus been outlined, rather broadly, the more important features of the invention in order that the summary and detailed description thereof that follows may be better understood, and in order that the present contribution to the art may be better appreciated. There are additional features of the invention that will be described hereinafter and which will form the subject matter of the claims appended hereto.

The embedded igniter for internal combustion engines is a multiple ignition system with separate control for individual pairs of igniters that has been designed to allow a more complete burn within the combustion chamber. This system can be incorporated into new internal combustion engines or can be an after-market system to be adapted to existing internal combustion engines where the spark plug hole has been plugged. The simplest embodiment of this embedded igniter system will consist of one or more of igniter units consisting of a pair of rectangular tantalum bars with iridium electrode pins at the ends. The rectangular shape of the tantalum bars maintains the desired position of the iridium electrode pins, not allowing them to rotate within their ceramic housing. The paired igniter pins are encased in an alumina ceramic, a high dielectric/high temperature housing positioned around the combustion chamber holding and insulating the electrodes relative to their position in reference to the combustion chamber. The fixed position between the electrodes is to maintain the desired spark gap. The position relative to the combustion chamber is to maintain a radial point to create the desired peripheral flame front. The igniter unit consists of a pair of rectangular tantalum bars with iridium electrode pins encased in the alumina ceramic housing that may be incorporated into a head gasket made from a composite of polyamide, carbon fiber and copper or equivalent material. The igniter units may also be incorporated into an internal combustion engine that does not require a head gasket, having the tantalum bars with iridium electrode pins encased in the alumina ceramic, sandwiched between the head and the engine block. With the incorporation of modern materials and technology the head gasket incorporating the embedded igniter, can attain a thickness of less than 0.070 inches.

A more complex first alternate embodiment of this embedded igniter system will consist of one or more sets of igniter units. Each igniter unit will consist of a pair of rectangular tantalum bars with iridium electrode pins at the ends. The paired igniter pins are encased in the alumina ceramic holding the electrodes in position. This embodiment will incorporate a metal foil of a printed circuit that will be isolated by high dielectric polyamide sheet, commonly called flexible printed circuit with one polarity on one side and the other polarity on the other side. The thickness and the width of the metal foil will be determined by voltage and amperage requirements. This foil circuit makes up the flexible printed circuit to connect the embedded electrodes to an external connector. The printed circuit structure will be of a high temperature substance and will be integrated into the head gasket by both liquid and film, to insure that all gaps are filled to prevent contamination. A thinner dielectric film is to be added on top and bottom to prevent cross arcing to the engine head or block. The external connector will be of a dielectric strength to facilitate the insulated coaxial connection from the transformer.

Each set of paired igniter pins is connected to an isolation transformer and then to a switching power supply. The external connection to the transformer is by way of a connection at the parting line between the head and the engine block through a conventional coaxial connector and cable. The transformer that fires the voltage for the desired spark at the embedded igniter is an isolation transformer that is allowed to switch polarity after each arcing discharge to prevent electron deposition. Using a switching power supply will alternately invert the voltage from positive to negative to the primary coils of the voltage transformers. This will increase the life of the electrode and will prevent electron deposition to one side of the paired electrodes. The duty cycles of the igniters increases as the Revolutions Per Minute or RPM increases. To extend the life of the paired electrodes even further, the transformer will be rotated, adjusting the assignment to the igniters so that the duty cycle could be reassigned at a pre-determined maintenance schedule.

This invention incorporates the igniter system into the head gasket, eliminating the spark plug. It will not consume the valuable area in the head, leaving more room for the valves. The embedded igniters around the perimeter of the combustion chamber produce a peripheral flame front that is so efficient that the igniters will be sequenced on as the RPM increase. Present day spark relies on auto advance to complete the combustion burn as RPM increases, because the burn time of combustion is the same with one spark plug. Initial timing for the embedded igniter will be preset to the desired advance. No auto advance timing will be needed for this invention. As the RPM increases the burn time will increase to be able to complete the burn up to 15 degrees after top dead center. By activating the next igniter, the burn time is accelerated by having two flame fronts and when the RPM is further increased, another igniter is activated to add an additional flame front. Four embedded igniters as described within this patent around each cylinder would be adequate, but at this time it must be clearly understood that any number of igniters of this style around one or more cylinders of an internal combustion engine will be covered within the scope of this patent.

With respect to the above description then, it is to be realized that the optimum dimensional relationships for the parts of the invention, to include variations in size, materials, shape, form, function and manner of operation, assembly and use, are deemed readily apparent and obvious to one skilled in the art. All equivalent relationships to those illustrated in the drawings and described in the specification will be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
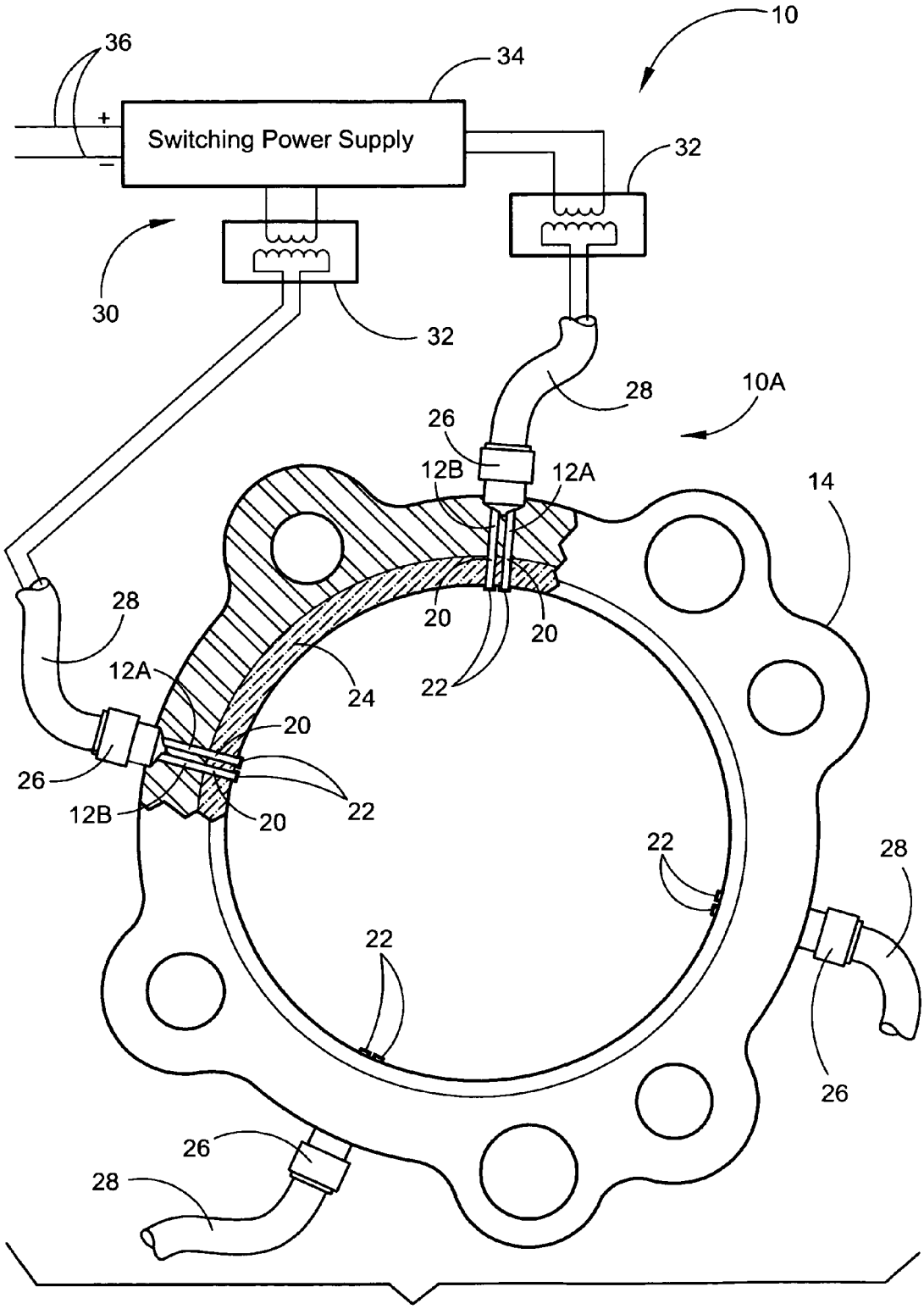
FIG. 1 depicts a plan view of a single cylinder air cooled head gasket incorporating the embedded igniter system along with a schematic illustrating the connections between the isolation transformers and the switching power supply.

Referring now to the drawings, wherein similar parts of the embedded igniter system 10 for internal combustion engines are identified by like reference numerals, there is seen in FIG. 1 four pairs of embedded igniters 12 embedded into a single cylinder head gasket 14. The cylinder head gasket 14 is composed of layers of dielectric polyamide materials 16 and carbon fiber materials 18. The primary igniter 12A and the secondary igniter 12B consist of rectangular tantalum bars 20 with iridium electrode pins 22 at the ends encased in an alumina ceramic insulation housing 24. The rectangular shape of the tantalum bar 20 insures a means that they will not rotate within the alumina ceramic insulation housing 24 although a variety of other geometric shapes will insure the anti-rotation feature, including square, and they all will be covered within the scope of this patent.

In the simplest embodiment of the embedded igniter system 10A depicted in FIG. 1, the tantalum bars 20 are directly connected to coaxial cable connectors 26 and a coaxial cable 28. A schematic 30 indicating two isolation transformers 32 and a single switching power supply 34 is shown connected to the coaxial cables 28. Each pair of embedded igniters 12 will require a separate isolation transformer 32 while a single switching power supply 34 may handle one or more isolation transformers 32. A DC line 36 from the electronic control unit (ECU) or the distributor of the internal combustion engine, will supply power to the switching transformer 34.

Figure 3:
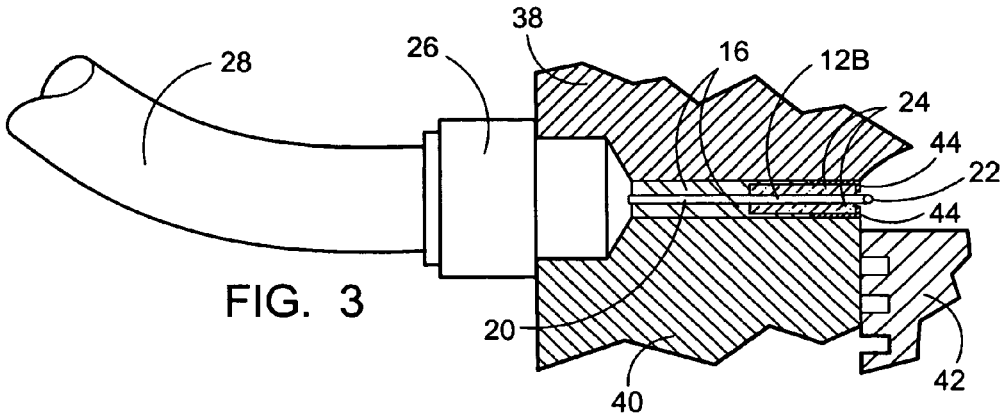
FIG. 3 depicts a side section view of the simplest embodiment of this embedded igniter system.
Figure 2:
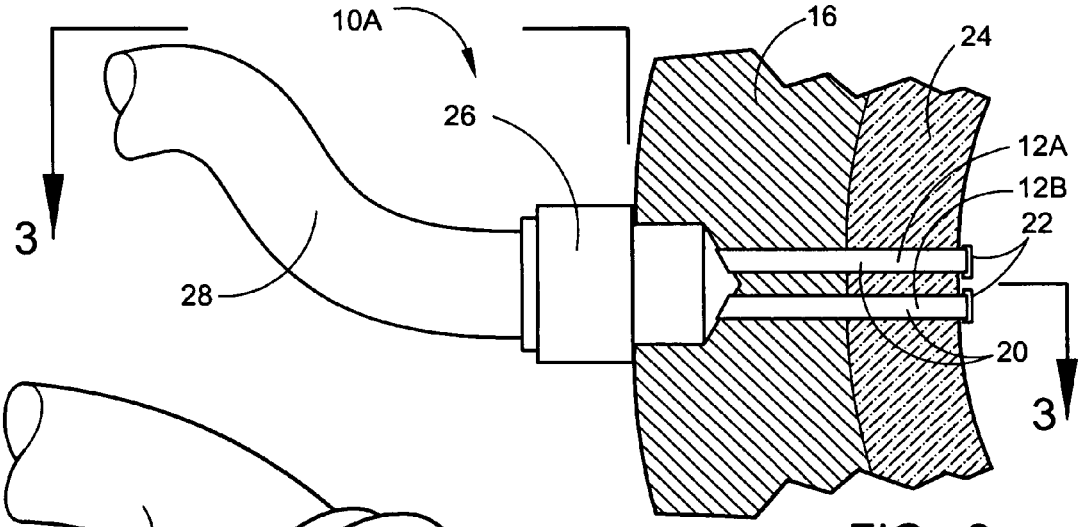
FIG. 2 depicts a plan view of the simplest embodiment of this embedded igniter system.
Figure 4:
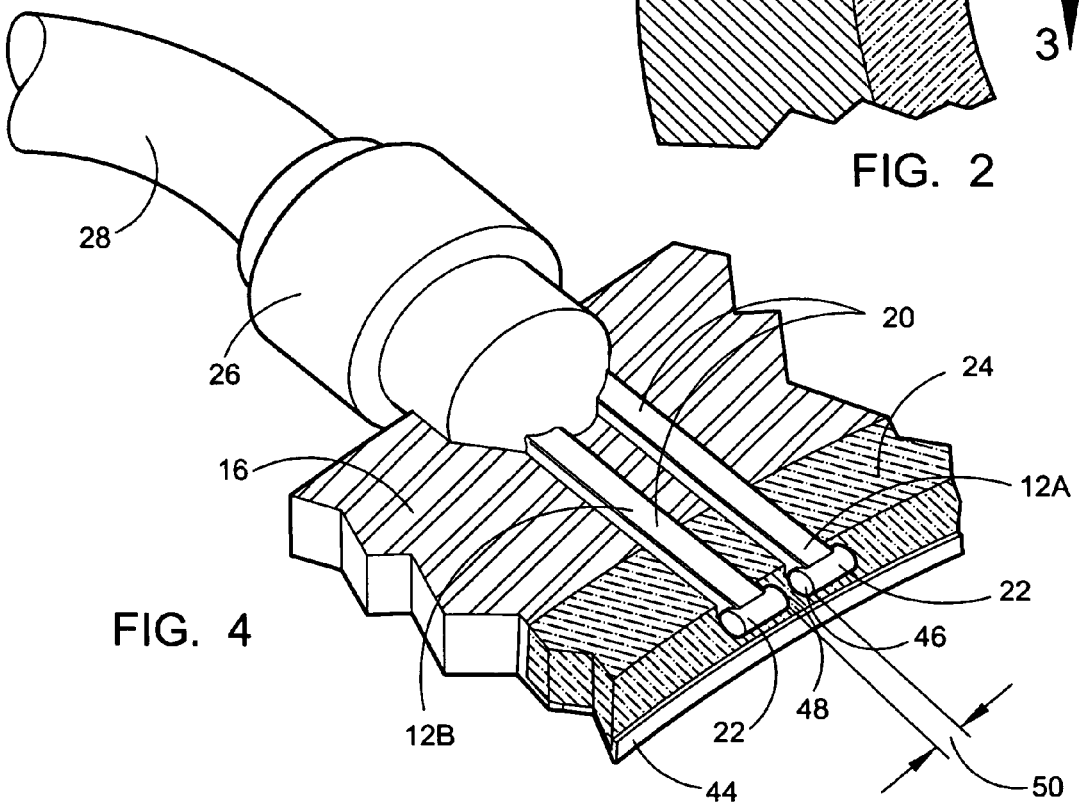
FIG. 4 depicts a perspective view of the simplest embodiment of this embedded igniter system.

FIG. 2 depicts a plan view of the simplest embodiment of this embedded igniter system 10A illustrating the separation of the tantalum bars 20 by the means of the alumina ceramic housing 24 and the cylinder head gasket 14 dielectric polyamide materials 16. FIG. 3 depicts a side section view of the simplest embodiment of this embedded igniter system 10A illustrating segments of the cylinder head 38, engine block 40 and piston 42. Two copper gasket rings 44 are at the top and bottom front edge of the alumina ceramic housing 24. FIG. 4 depicts a perspective view of the simplest embodiment of this embedded igniter system 10A clarifying the shape and positioning of the iridium electrode pins 22 with their initial size being 0.024 inches in diameter and 0.040 long, their opposing contact surfaces 46 and 48, along with the spark gap 50 of 0.028 inches.

Figure 5:
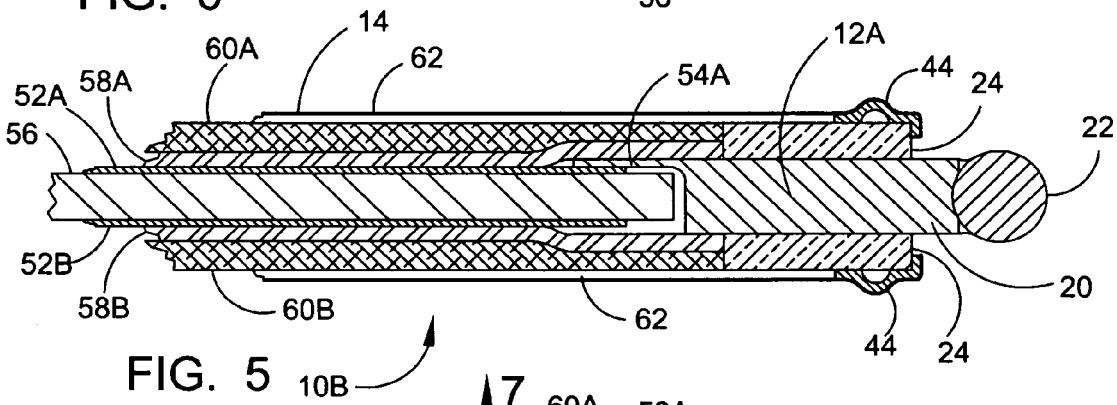
FIG. 5 depicts a side section view of the first alternate embodiment using the metal foil of a printed circuit for a means of connection between the igniter components and the coaxial connector, illustrating the connection means between the primary igniter and the metal foil.

FIG. 5 depicts a side section view of the first alternate embodiment of the embedded igniter system 10B using the printed circuit metal foil 52A for a means of connection to the tab end 54A of the tantalum bar 20 of the primary igniter 12A to the coaxial connector 26. Permanent connection between the tab end 54 of the tantalum bar 20 and the metal foil 52A may be made by the means of hot or cold solder. The center section or circuit board 56 will be fabricated from a dielectric polyamide material 16 with metal foil 52A on top and metal foil 52B on the bottom. Cover layers 58A and 58B of a dielectric polyamide material or equivalent will cover the metal foil 52A on top and metal foil 52B on the bottom with support layers 60A and 60B of carbon fiber material 18 covering layers 58A and 58B. A bonding coating 62 will seal the top and bottom of the complete cylinder head gasket 14.

Figure 6:
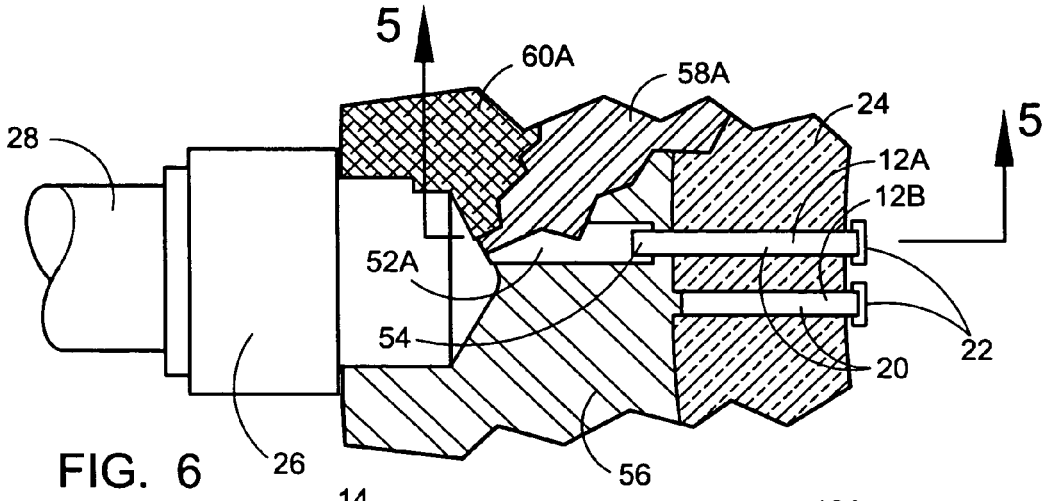
FIG. 6 depicts a section plan view through the upper portion of the first alternate embodiment using the metal foil of a printed circuit for a means of connection between the igniter components and the coaxial connector, illustrating the connection means between the primary igniter and the metal foil.

FIG. 6 depicts a section plan view through the upper portion of the first alternate embodiment of the embedded igniter system 10B using the metal foil 52A of a printed circuit for a means of connection between tantalum bar 20 tab end 54A and the coaxial connector 26. This drawing illustrates the connection means between the primary igniter 12A tantalum bar 20 tab end 54A and the printed circuit metal foil 52A using a hot or cold solder.

Figure 7:
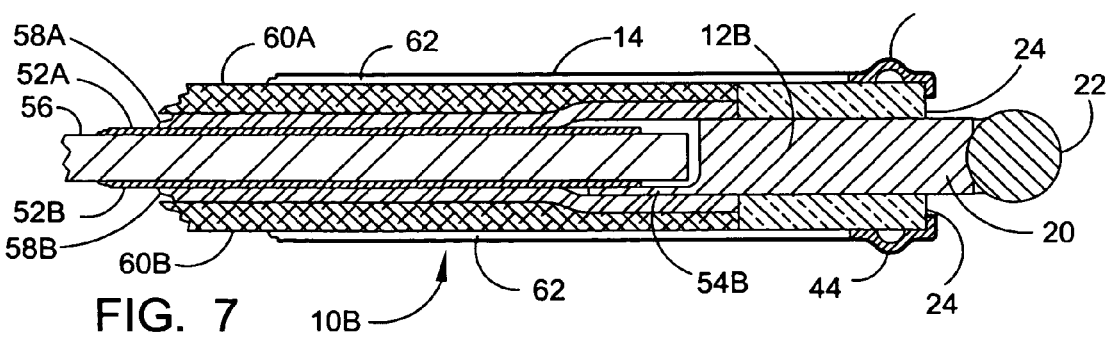
FIG. 7 depicts a side section view of the first alternate embodiment using the metal foil of a printed circuit for a means of connection between the igniter components and the coaxial connector, illustrating the connection means between the secondary igniter and the metal foil.
Figure 9:
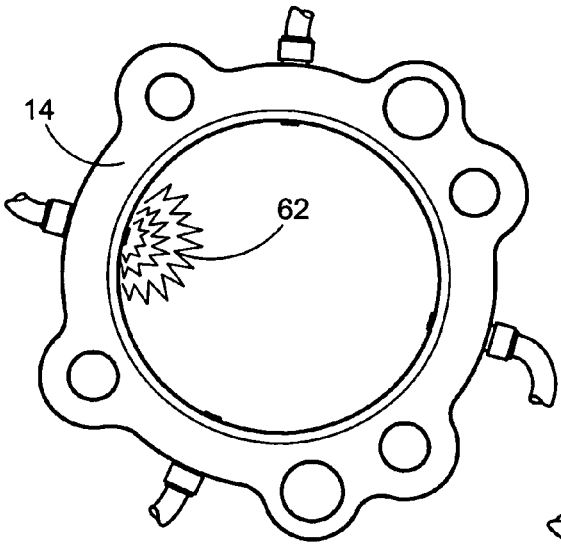
FIG. 9 depicts a plan view of a single cylinder head gasket with four embedded igniters indicating a single igniter ignition.
Figure 10:
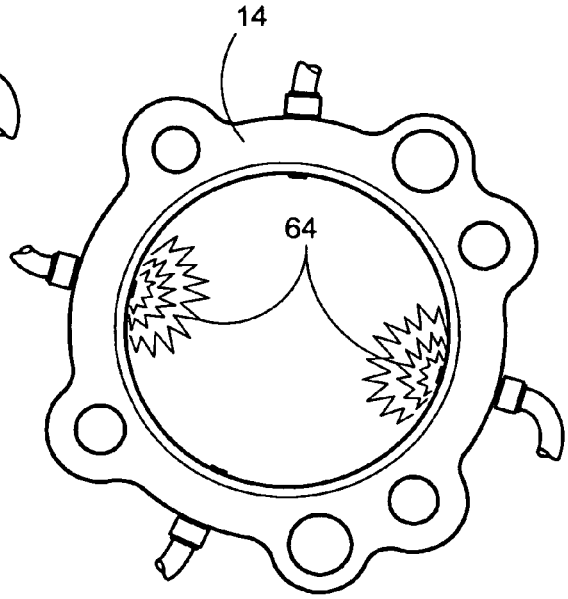
FIG. 10 depicts a plan view of a single cylinder head gasket with four embedded igniters indicating two igniter ignitions.
Figure 11:
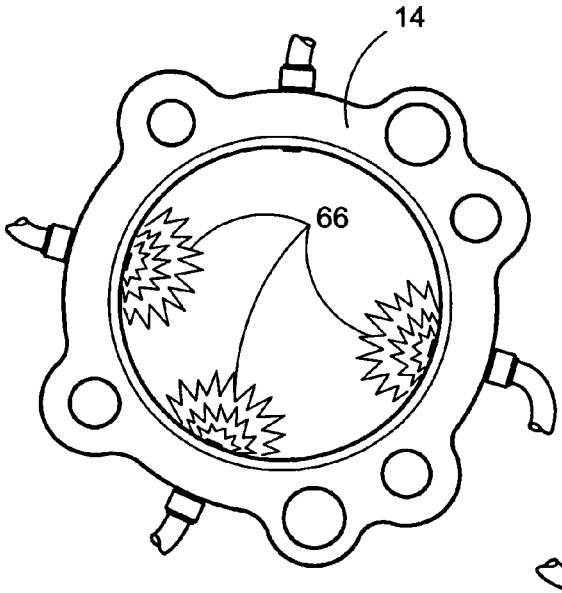
FIG. 11 depicts a plan view of a single cylinder head gasket with four embedded igniters indicating three igniter ignitions.
Figure 12:
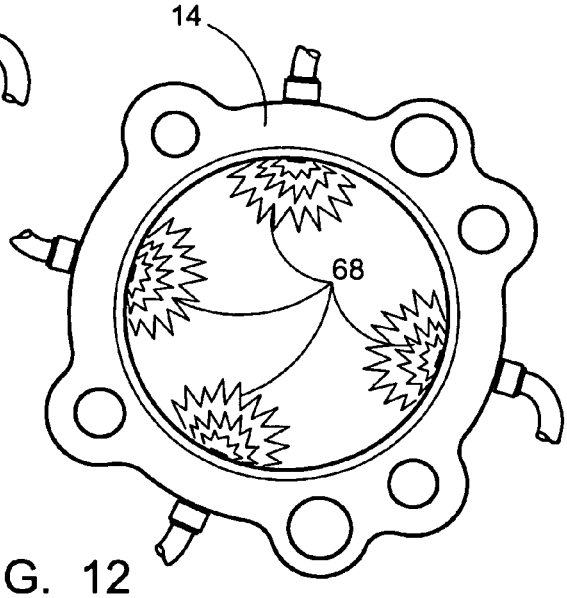
FIG. 12 depicts a plan view of a single cylinder head gasket with four embedded igniters indicating four igniter ignitions.

FIG. 7 depicts a side section view of the first alternate embodiment of the embedded igniter system 10B using the printed circuit metal foil 52A for a means of connection to the tab end 54B of the tantalum bar 20 of the primary igniter 12B to the coaxial connector 26. The center section or circuit board 56 will be fabricated from a dielectric polyamide material 16 with metal foil 52A on top and metal foil 52B on the bottom. Cover layers 58A and 58B of a dielectric polyamide material or equivalent will cover the metal foil 52A on top and metal foil 52B on the bottom with support layers 60A and 60B of carbon fiber material 18 covering layers 58A and 58B. A bonding coating 62 will seal the top and bottom of the complete cylinder head gasket 14.

Figure 8:
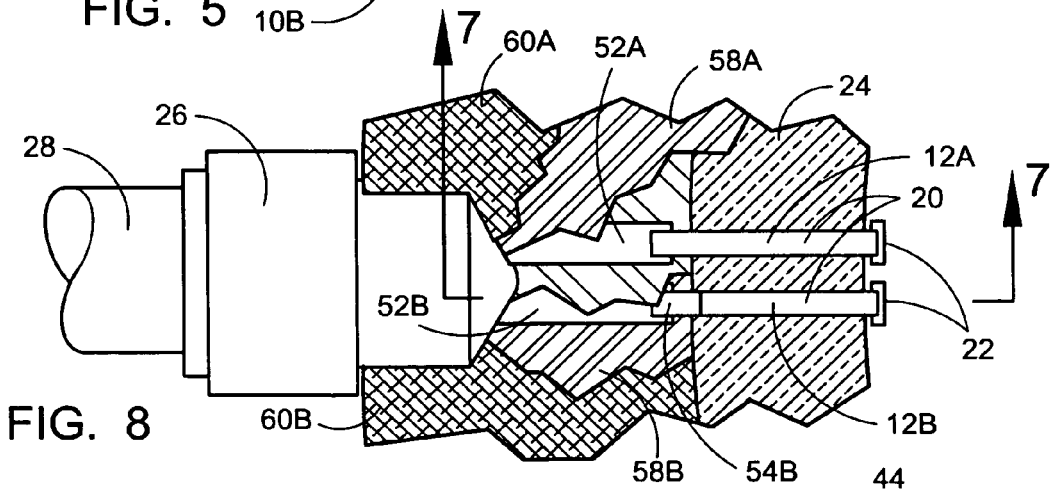
FIG. 8 depicts a section plan view through the upper portion of the first alternate embodiment using the metal foil of a printed circuit for a means of connection between the igniter components and the coaxial connector, illustrating the connection means between the secondary igniter and the metal foil.

FIG. 8 depicts a section plan view through the lower portion of the first alternate embodiment of the embedded igniter system 10B using the metal foil 52B of a printed circuit for a means of connection between tantalum bar 20 tab end 54B and the coaxial connector 26. This drawing illustrates the connection means between the primary igniter 12B tantalum bar 20 tab end 54B and the printed circuit metal foil 52A using a hot or cold solder.

FIGS. 9, 10, 11 and 12 depicts plan views of a single cylinder head gasket with four embedded igniters indicating a single igniter ignition 62, two igniter ignitions 64, three igniter ignitions 66, and four igniter ignitions 68. The unique controlled firing characteristics of the invention allow that the igniter system 10 can fire the ignitions simultaneously or with a momentary delay between each ignition.

Figure 13:
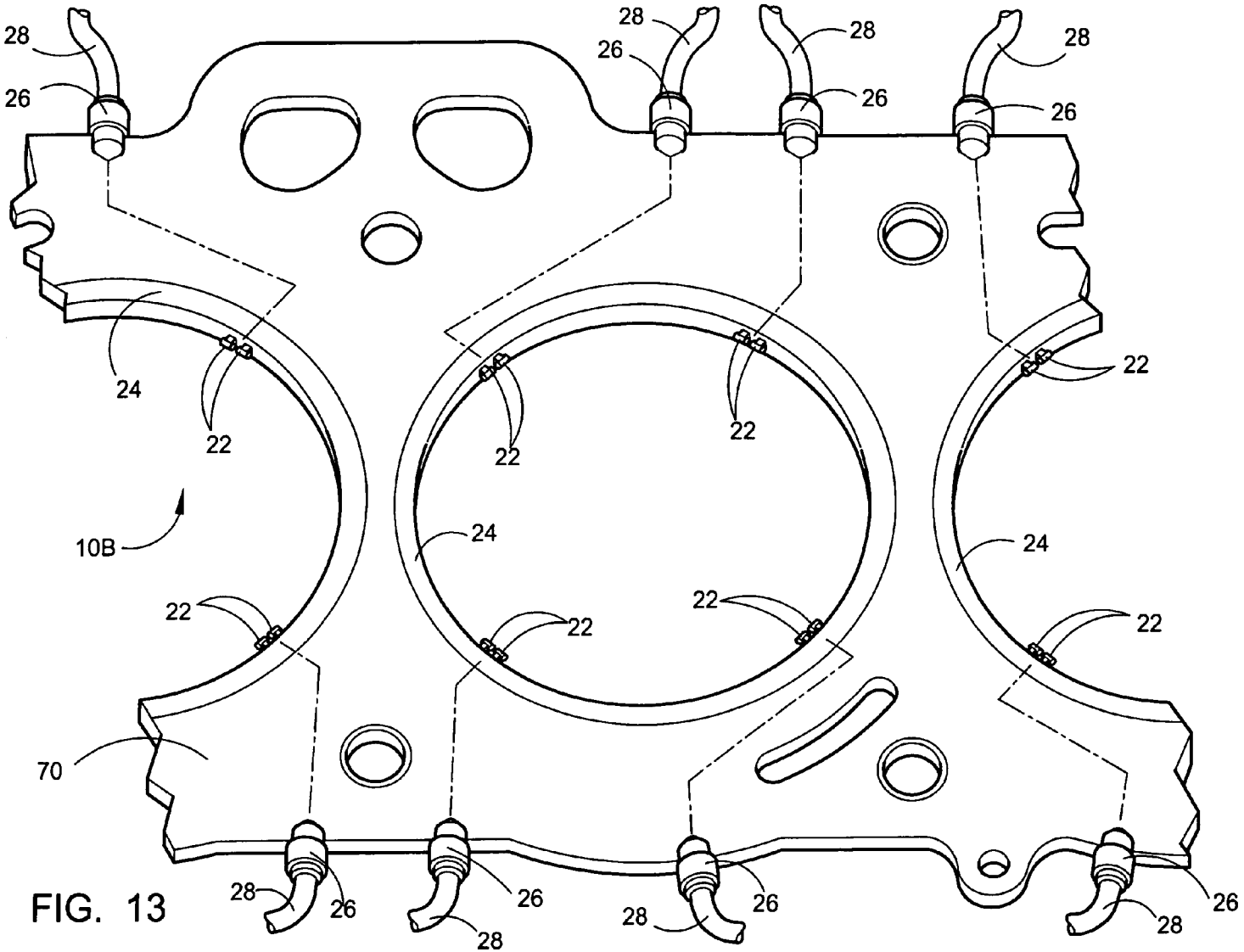
FIG. 13 depicts a perspective view of a conventional multi-cylinder head gasket employing the metal foil of a printed circuit for a means of connection between the igniter components and the coaxial connector.

FIG. 13 depicts a perspective view of a conventional multi-cylinder head gasket 70 employing the metal foil of a printed circuit for a means of connection between the embedded igniters 12A and 12B and the coaxial cable connectors 26.

Figure 14:
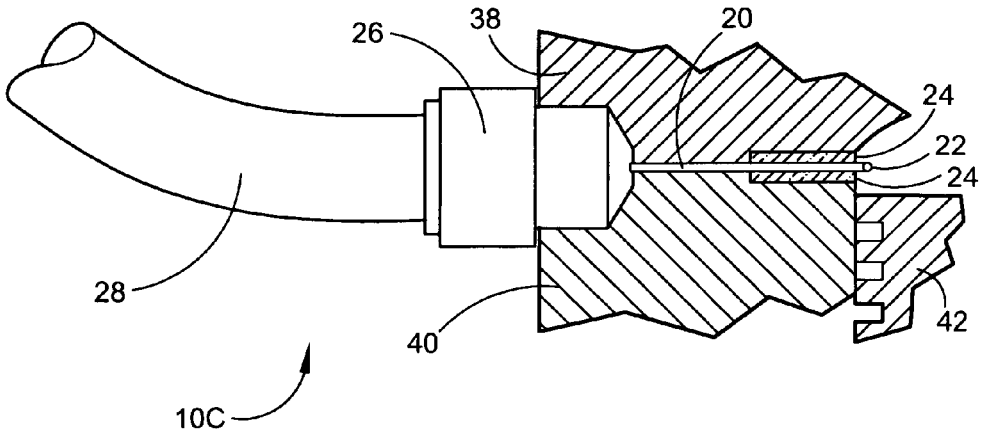
FIG. 14 depicts a side section view of the simplest embodiment of this embedded igniter incorporated into an internal combustion engine that does not require a head gasket.

FIG. 14 depicts a side section view of the simplest embodiment of this embedded igniter system 10C incorporated into an internal combustion engine where the cylinder head 38 and the engine block 40 come in direct contact and do not require a head gasket 14.

Figure 15:
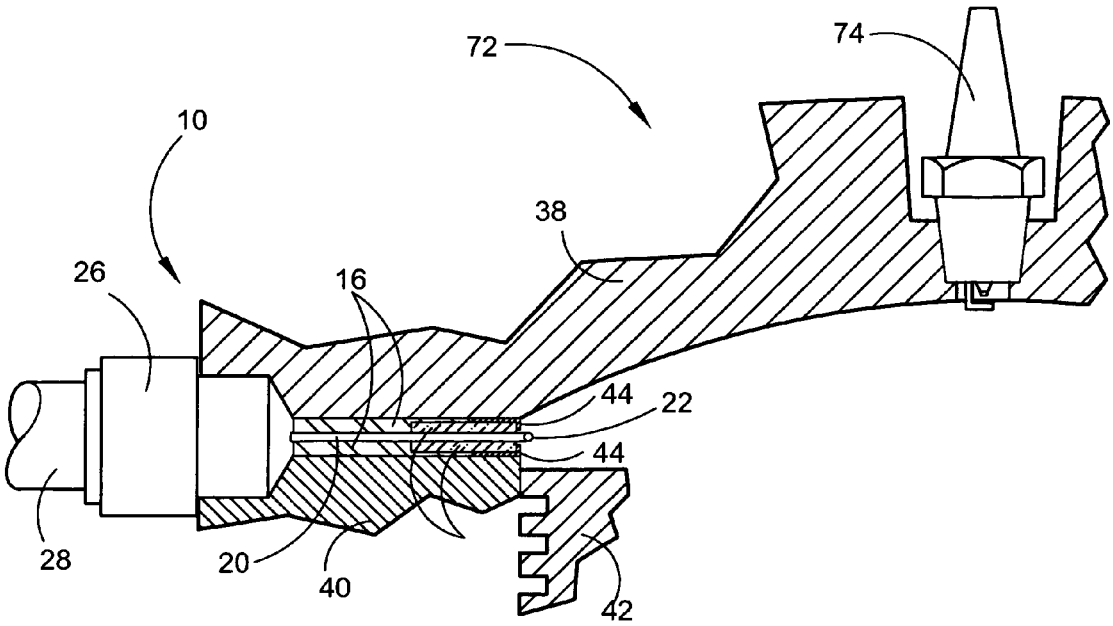
FIG. 15 depicts a side section view of the simplest embodiment of this embedded igniter incorporated into a conventional internal combustion engine with a spark plug as a reference.

FIG. 15 depicts a side section view of the simplest embodiment of this embedded igniter system 10 incorporated into a conventional internal combustion engine 72 with a spark plug 74.

The embedded igniter system for internal combustion engines 10 shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described may be employed for providing an embedded igniter system for internal combustion engines 10 in accordance with the spirit of this invention. Such changes, alternations and modifications as would occur to those skilled in the art are considered to be within the scope of this invention as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. An embedded igniter system for internal combustion engines, comprising:

(a) a high dielectric high temperature resistant insulative housing;

(b) one or more a pairs of electrode bars having a distal and proximal end, parallel with respect to each other, affixed within said insulative housing such that a gap runs between each said electrode bar;

(c) an electrode pin affixed to the distal end of each of said electrode bars;

(d) a coaxial cable connector in electronic communication with the proximal end of each of said electrode bars; and (e) a switching power supply having one or more isolation transformers, in electrical communication with said coaxial cable;

whereby said switching power supply, through said isolation transformers, sends voltage to each of said electrode bars and causes a spark between each of said electrode pins to combust fuel present within a combustion chamber.

2. The embedded igniter system for internal combustion engines, according to claim 1, wherein said high dielectric high temperature insulative housing is constructed of alumina.

3. The embedded igniter system for internal combustion engines, according to claim 1, wherein said electrode bars are constructed of tantalum, tungsten, or palladium, or alloys thereof.

4. The embedded igniter system for internal combustion engines, according to claim 1, wherein said electrode pins are constructed of iridium or platinum, or alloys thereof.

5. The embedded igniter system for internal combustion engines, according to claim 1, wherein said electrode pins are set at a specified gap as per the specifications for the internal combustion engine so equipped.

6. The embedded igniter system for internal combustion engines, according to claim 1, wherein said gap is about 0.010 to 0.050 inches in length.

7. The embedded igniter system for internal combustion engines, according to claim 1, wherein said electrode pins are about 0.024 inches in diameter and 0.040 inches long.

8. The embedded igniter system for internal combustion engines, according to claim 1, wherein said high dielectric high temperature resistant insulative housing acts as both an insulator and a positional control for the embedded igniters.

9. The embedded igniter system for internal combustion engines, according to claim 1, wherein said switching power supply is powered via a DC line from the electronic control unit (ECU) or the distributor of the internal combustion engine.

10. A method for making an embedded igniter system for internal combustion engines, comprising the steps of:

(a) providing a high dielectric high temperature resistant insulative housing;

(b) providing one or more a pairs of electrode bars having a distal and proximal end, parallel with respect to each other, affixed within said insulative housing such that a gap runs between each said electrode bar;

(c) providing an electrode pin affixed to the distal end of each of said electrode bars;

(d) providing a coaxial cable connector in electronic communication with the proximal end of each of said electrode bars; and (e) providing a switching power supply having one or more isolation transformers, in electrical communication with said coaxial cable;

whereby said switching power supply, through said isolation transformers, sends voltage to each of said electrode bars and causes a spark between each of said electrode pins to combust fuel present within a combustion chamber.

11. The method for making an embedded igniter system for internal combustion engines according to claim 10, wherein said step of providing said high dielectric high temperature insulative housing includes the step of providing said high dielectric high temperature insulative housing constructed of alumina.

12. The method for making an embedded igniter system for internal combustion engines according to claim 10, wherein said step of providing electrode bars includes the step of providing electrode bars constructed of tantalum, tungsten, or palladium, or alloys thereof.

13. The method for making an embedded igniter system for internal combustion engines according to claim 10, wherein said step of providing electrode pins includes the step of providing electrode pins constructed of iridium or platinum, or alloys thereof.

14. The method for making an embedded igniter system for internal combustion engines according to claim 10, wherein said step of providing electrode pins includes the step of providing electrode pins set at a specified gap as per the specifications for the internal combustion engine so equipped.

15. The method for making an embedded igniter system for internal combustion engines according to claim 10, wherein said step of providing electrode pins includes the step of providing electrode pins set at a specified gap as per the specifications for the internal combustion engine so equipped, and further wherein said gap is about 0.010 to 0.050 inches in length.

16. The method for making an embedded igniter system for internal combustion engines according to claim 10, wherein said step of providing electrode pins includes the step of providing electrode pins wherein said electrode pins are about 0.024 inches in diameter and 0.040 inches long.

17. The method for making an embedded igniter system for internal combustion engines according to claim 10, wherein said step of providing a high dielectric high temperature resistant insulative housing includes the step of providing said insulative housing wherein said high dielectric high temperature resistant insulative housing acts as both an insulator and a positional control for the embedded igniters.

18. The method for making an embedded igniter system for internal combustion engines according to claim 10, wherein said step of providing a switching power supply includes the step of providing a switching power supply wherein said switching power supply is powered via a DC line from the electronic control unit (ECU) or the distributor of the internal combustion engine.

19. A method for using an embedded igniter system for internal combustion engines, comprising the steps of:

(a) providing an embedded igniter system having a high dielectric high temperature resistant insulative housing, one or more a pairs of electrode bars having a distal and proximal end, parallel with respect to each other, affixed within said insulative housing such that a gap runs between each said electrode bar, an electrode pin affixed to the distal end of each of said electrode bars, a coaxial cable connector in electronic communication with the proximal end of each of said electrode bars, and a switching power supply having one or more isolation transformers, in electrical communication with said coaxial cable;

(b) removing the existing conventional spark plugs and spark plug wiring system from the internal combustion engine;

(c) removing the conventional head gasket surrounding each cylinder within the internal combustion engine;

(d) replacing the removed head gasket with said provided embedded igniter system of step a); and (e) wiring said provided switching power supply to the existing electrical system for the internal combustion engine via a DC electrical line.

20. The method for making an embedded igniter system for internal combustion engines according to claim 19, wherein said step of providing an embedded igniter system having a high dielectric high temperature resistant insulative housing, one or more a pairs of electrode bars having a distal and proximal end, parallel with respect to each other, affixed within said insulative housing such that a gap runs between each said electrode bar, an electrode pin affixed to the distal end of each of said electrode bars, a coaxial cable connector in electronic communication with the proximal end of each of said electrode bars, and a switching power supply having one or more isolation transformers, in electrical communication with said coaxial cable, further includes providing said embedded igniter system having one or more electrode pairs whereby the power provided to each electrode pairs is controlled based upon the RPM of the internal combustion engine.

* * * * *